US011273566B2

(12) United States Patent
Gklezos et al.

(10) Patent No.: US 11,273,566 B2
(45) Date of Patent: Mar. 15, 2022

(54) SHAVER HANDLE WITH ADJUSTABLE WEIGHT

(71) Applicant: Bic Violex S.A., Anixi (GR)

(72) Inventors: Ilias Gklezos, Attiki (GR); Georgios Paspatis, Arcadia (GR)

(73) Assignee: Bic Violex S.A., Anoixi (GR)

( * ) Notice: Subject to any disclaimer, the term of this patent is extended or adjusted under 35 U.S.C. 154(b) by 139 days.

(21) Appl. No.: 16/582,731

(22) Filed: Sep. 25, 2019

(65) Prior Publication Data

US 2021/0086380 A1 Mar. 25, 2021

(51) Int. Cl.
*B26B 21/52* (2006.01)

(52) U.S. Cl.
CPC ..... *B26B 21/52* (2013.01)

(58) Field of Classification Search
CPC ..... B26B 21/52; B26B 21/522; B26B 21/523; B26B 21/525; B26B 21/526; B26B 21/527; B26B 21/528
See application file for complete search history.

(56) References Cited

U.S. PATENT DOCUMENTS 2,132,293 A * 10/1938 Harrer ..... B26B 21/52 30/526
2,235,841 A * 3/1941 Monnet ..... B26B 21/52 30/526
2,264,323 A * 12/1941 Monnet ..... B26B 21/18 30/72
2,387,765 A * 10/1945 Monnet ..... B26B 21/52 30/34.05
4,828,266 A * 5/1989 Tunstall ..... A63B 53/0487 473/336
5,263,694 A * 11/1993 Smith ..... B60G 15/068 267/162
6,026,578 A * 2/2000 Brenner ..... B26B 21/523 30/526
6,370,783 B1 * 4/2002 Bozikis ..... B26B 21/52 15/167.1
2009/0007434 A1 * 1/2009 Kwok ..... B26B 3/00 30/125
2009/0158600 A1 * 6/2009 Ishai ..... B26B 3/00 30/314
2016/0016057 A1 * 1/2016 Wang ..... A63B 53/14 473/297
2018/0056531 A1 * 3/2018 Liu ..... B25G 1/00

FOREIGN PATENT DOCUMENTS

EP 2073963 B1 5/2011
GB 545789 A 6/1942

OTHER PUBLICATIONS

Mad Catz RAT 5 Gaming Mouse, retrieved from https://www.youtube.com/watch?v=Glnm0REIS3Q, published on Oct. 4, 2013 (1 page).

* cited by examiner

*Primary Examiner* — Jonathan G Riley
(74) *Attorney, Agent, or Firm* — Bookoff McAndrews, PLLC

(57) ABSTRACT

A shaver handle assembly may include: a body defining a cavity; one or more weights insertable into the cavity; a cap removably coupled to the body to enable access to the cavity when the cap is removed from the body; and a biasing member configured to abut at least one of the one or more weights, to secure the one or more weights within the cavity.

13 Claims, 7 Drawing Sheets

SHAVER HANDLE WITH ADJUSTABLE WEIGHT

TECHNICAL FIELD

The present disclosure relates generally to a shaver handle and mechanisms for adjusting a weight of the shaver handle.

DESCRIPTION OF RELATED TECHNOLOGY

Usually, shaver handles have a fixed, non-adjustable, weight. For instance, a shaver handle may have a standard weight. The standard weight is set by using an inner core made from metal material with a plastic material surrounding the inner core, or by using a metal material for the shaver handle entirely such that a user may not have an option to adjust the weight of the shaver handle.

SUMMARY

In one aspect, this disclosure is directed to a shaver handle assembly, comprising: a body defining a cavity; one or more weights insertable into the cavity; a cap removably coupled to the body to enable access to the cavity when the cap is removed from the body; and a biasing member configured to abut at least one of the one or more weights, to secure the one or more weights within the cavity.

In another aspect, this disclosure is directed to a shaver handle assembly, comprising: a body defining a cavity; one or more weights insertable into the cavity; a cap removably coupled to the body to enable access to the cavity when the cap is removed from the body; and a telescoping rod configured to secure the one or more weights within the cavity, wherein the telescoping rod includes two or more sections configured to slide relative to one another as the telescoping rod is compressed or extended.

In yet another aspect, this disclosure is directed to a shaver, comprising: a shaver head; and a handle coupled to the shaver head, the handle including: a body defining a cavity; one or more weights insertable into the cavity; a cap removably coupled to the body to enable access to the cavity when the cap is removed from the body; and a biasing member configured to abut at least one of the one or more weights, to secure the one or more weights within the cavity.

BRIEF DESCRIPTION OF THE DRAWINGS

The accompanying drawings, which are incorporated in and constitute a part of this disclosure, illustrate various exemplary embodiments and together with the description, serve to explain the principles of the disclosure.

Aspects of the disclosure may be implemented in connection with embodiments illustrated in the attached drawings. These drawings show different aspects of the present disclosure and, where appropriate, reference numerals illustrating like structures, components, materials and/or elements in different figures are labeled similarly. It is understood that various combinations of the structures, components, and/or elements, other than those specifically shown, are contemplated and are within the scope of the present disclosure. There are many aspects and embodiments described herein. Those of ordinary skill in the art will readily recognize that the features of a particular aspect or embodiment may be used in conjunction with the features of any or all of the other aspects or embodiments described in this disclosure.

DETAILED DESCRIPTION

Both the foregoing general description and the following detailed description are exemplary and explanatory only and are not restrictive of the features, as claimed. As used herein, the terms "comprises," "comprising," or other variations thereof, are intended to cover a non-exclusive inclusion such that a process, method, article, or apparatus that comprises a list of elements does not include only those elements, but may include other elements not expressly listed or inherent to such a process, method, article, or apparatus. Additionally, the term "exemplary" is used herein in the sense of "example," rather than "ideal." It should be noted that all numeric values disclosed or claimed herein (including all disclosed values, limits, and ranges) may have a variation of +/−10% (unless a different variation is specified) from the disclosed numeric value. Moreover, in the claims, values, limits, and/or ranges mean the value, limit, and/or range +/−10%. As used herein, the terms "about," "substantially," and "approximately," indicate a range of values within +/−10% of the stated value. Furthermore, the term "about equal" used to compare different values may mean that the values are within +/−10% of one another.

The present disclosure is related to shaver handles, and shavers including shaver handles having a weight that is adjustable by a user. For example, the user may adjust the weight of the shaver handle based on usage (body trimming, face shaving, etc.), preference (lighter or heavier handle), or any other similar facets of shaving. In one aspect of the disclosure, the user may easily add or remove one or more weights to achieve the user's ideal and/or desired handle weight prior to shaving. It is contemplated that the user may first use the shaver at a first weight, and subsequently adjust the weight based on the perceived experience of the user while shaving with the shaver at the first weight. To achieve the weight adjustment, the user may remove a cap of the shaver handle and remove or add one or more weights from a cavity. The weights inside the cavity may be secured in place inside the cavity by a compressible biasing member (e.g., a spring) and a rod. The cavity may be sealed from an external environment of the shaver handle by a sealing member, so that water, shaving debris, and/or other contaminants do not enter the cavity while the sealing member is engaged between the cap and the shaver handle. Furthermore, it is contemplated that an interior of the shaver, including an interior of the handle, does not include any liquid or damping fluid. Thus, embodiments of the present disclosure are configured to provide for adjustable weighted shaver handles having secured (not loose) weights in a moisture-sealed manner.

Figure 1:
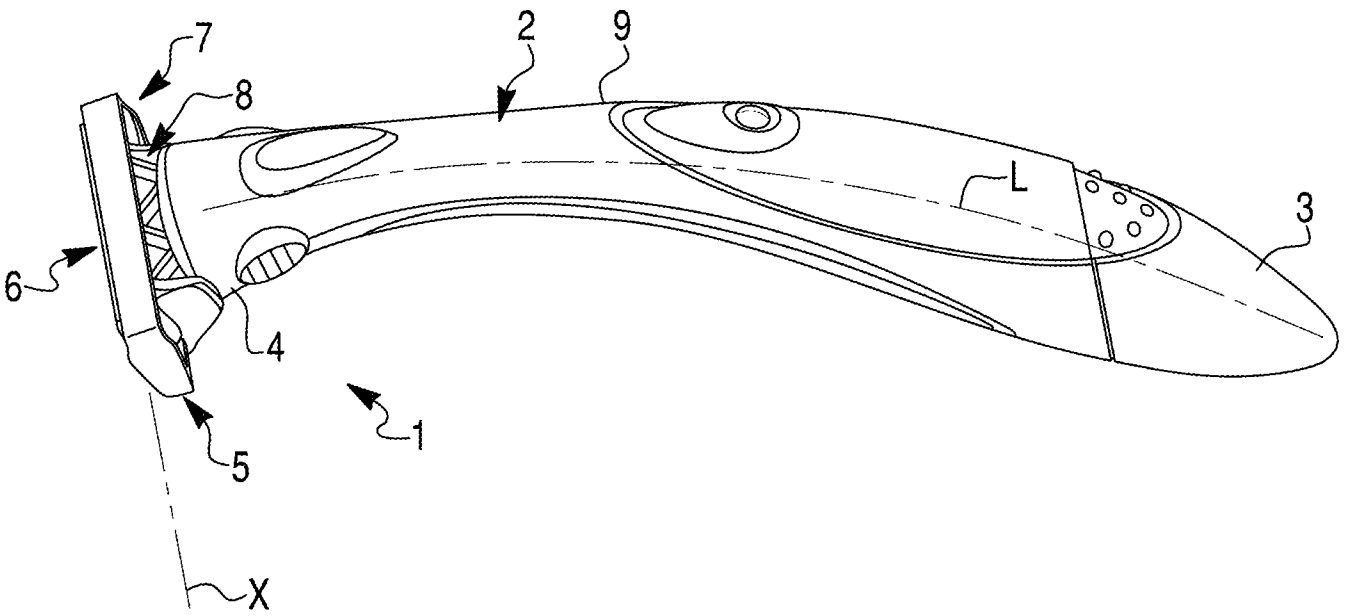
FIG. 1 is a perspective view of a shaver.

FIG. 1 shows a shaver 1 (e.g., a safety razor) suitable for wet shaving. Shaver 1 may include a shaver handle 2 and a blade unit 5. The shaver handle 2 may have a body 9 extending along a longitudinal direction L between a proximal portion 3 and a distal portion 4. The blade unit 5 or shaver head may be positioned at distal portion 4. The longitudinal direction L may be curved or include one or more straight portions.

Blade unit 5 may include an upper face 6 equipped with one or more blades, and a lower face 7 which is coupled to distal portion 4 of the shaver handle 2 by a connection mechanism 8. Connection mechanism 8 may for instance enable blade unit 5 to pivot relative to a pivot axis X, which is substantially perpendicular to the longitudinal direction L. Connection mechanism 8 may further enable selective release of blade unit 5 for the purpose of exchanging blade units.

Figure 2:
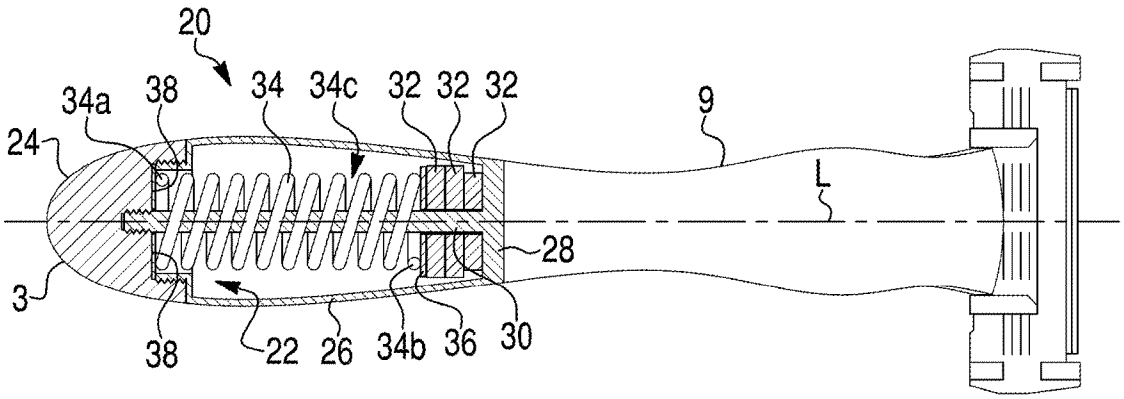
FIG. 2 is a top-down view of a shaver with an exemplary shaver handle shown in cross-section, according to a first aspect of the disclosure.
Figure 3:
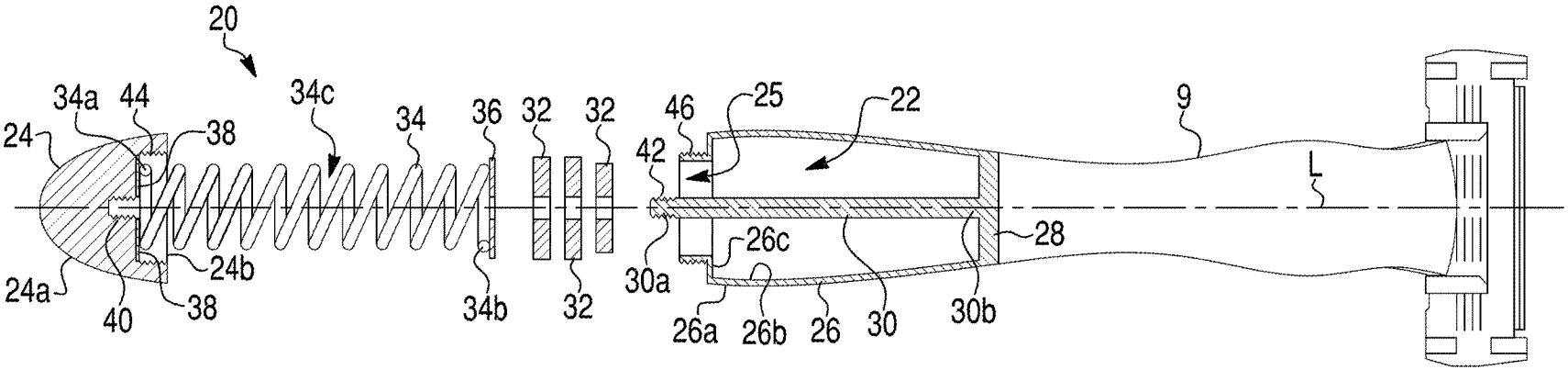
FIG. 3 is a top-down view of the shaver with the exemplary shaver handle shown in cross-section and exploded, according to the first aspect of the disclosure.

FIG. 2 is a top-down view of the shaver 1 with an exemplary shaver handle 2 shown in cross-section, according to a first aspect of the disclosure. FIG. 3 is a top-down view of the shaver 1 with the exemplary shaver handle 2 shown in cross-section and exploded, according to the first aspect of the disclosure. Specifically, the shaver handle 2 may include an adjustable weight assembly 20. In FIG. 2, the top-down view of the exemplary shaver handle 2 shown in cross-section depicts the adjustable weight assembly 20 with three weights 32. However, any suitable number of weights may be used including, zero, one, two, four, five, or more weights 32 positioned within the shaver handle 2 at any time.

The adjustable weight assembly 20 may be located closer to the proximal portion 3 or to the distal portion 4 (or equally in between), along the longitudinal direction L (or offset therefrom). For instance, the adjustable weight assembly 20 may be positioned within the proximal portion 3 (as depicted in FIGS. 2 and 3) or positioned within the distal portion 4 of the shaver handle 2. In yet another embodiment, the adjustable weight assembly 20 may be positioned within both the proximal portion 3 and the distal portion 4 of the shaver handle 2

The adjustable weight assembly 20 may include a cap 24, side wall 26, and a base 28 creating a cavity 22 within the shaver handle 2. An opening 25 may be positioned at the proximal portion 3, and the opening 25 may enable access to cavity 22. Furthermore, opening 25 may be closed off or sealed when cap 24 is coupled to the shaver handle 2, and may be open to the external environment when cap 24 is removed from the shaver handle 2. The adjustable weight assembly 20 may also include a rod 30, one or more weight(s) 32 (each with a hole 32*a* extending therethrough), a biasing member 34, a ring 36, and a sealing member 38.

The base 28 may be a wall, defining the distal end of the cavity 22, within the shaver handle 2. For instance, the base 28 may form a portion of an interior surface of the shaver handle 2 that surrounds cavity 22. The base 28 may extend in a direction transverse (or perpendicular) to the longitudinal direction L. The base 28 may segment the adjustable weight assembly 20 from another cavity within the shaver handle 2, for example, another cavity distal to cavity 22. Alternatively, portions of handle 2 distal to base 28 may be solid (i.e., without any cavity).

The side wall 26 may proximally from the base 28. In some examples, side wall 26 may be a straight cylinder. In other embodiments, side wall 26 include one or more undulations along longitudinal direction L. In yet another embodiment, side wall 26 may include undulations on an outer surface 26*a* of the side wall 26, while defining a straight cylinder around cavity 22 with an interior surface 26*b* of the side wall 26. The side wall 26 may extend from the base 28 to a proximal end 26*c* at or adjacent to the opening 25. The side wall 26 may include one or more segments (e.g., panels) that may be coupled/sealed together, or side wall 26 may be a unitary body (e.g., formed by extrusion) to form the outer surface 26*a* of the shaver handle 2 and a portion of the interior surface 26*b* surrounding the cavity 22 (with the base 28 and the cap 24 forming other portions of the interior surface 26*b* surrounding the cavity 22). The proximal end 26*c* of the side wall 26 may include a second thread 46.

The rod 30 may extend through the cavity 22 (either entirely or substantially). For instance, the rod 30 may extend from the base 28 towards the opening 25 through the cavity 22. The rod 30 may have a base end 30*b* and a connector end 30*a*. The rod 30 may be fixed to the base 28 at the base end 30*b*, or the rod 30 may be unitarily formed with the base 28 at the base end 30*b*. The base end 30*b* may be fixed to or formed at a radial center of the base 28. However, it also is contemplated that base end 30*b* may be offset from the radial center of base 28. The rod 30 may extend through the cavity 22 along or parallel to the longitudinal direction L. The rod 30 may extend from the base end 30*b* to the connector end 30*a* for at least a length of the sidewall 26. Thus, the rod 30 may extend outside and proximal to the opening 25. The rod 30 may include a first thread 42 at the connector end 30*a*.

The opening 25 may be a space positioned at the proximal end 26*c* of the side wall 26. The opening 25 may be of sufficient dimensions (e.g., width) for the one or more weight(s) 32, the biasing member 34, and the ring 36 to pass through the opening 25 into the cavity 22. Generally, a cross-sectional area of the opening 25 may at least circumscribe and/or otherwise surround cross-sectional areas of the one or more weight(s) 32, the biasing member 34, and the ring 36, so that the one or more weight(s) 32, the biasing member 34, and the ring 36 may pass through the opening 25 into the cavity 22.

The cavity 22 may receive the one or more weight(s) 32, the ring 36, and the biasing member 34, as discussed below. The cavity 22 may be sealed from an external environment when the cap 24 is coupled to the shaver handle 2 and the sealing member 38 is engaged with the proximal end 26*c* of the side wall 26, as discussed below.

The cap 24 may open and close the opening 25 of the cavity 22. The cap 24 may include an exterior surface 24*a* and an interior surface 24*b*. The exterior surface 24*a* of the cap 24 may form a portion of the exterior surface of the shaver handle 2, and the interior surface 24*b* of the cap 24 may form a portion of the interior surface surrounding the cavity 22. For instance, the interior surface 24*b* of the cap 24 may extend in the direction transverse (e.g., perpendicular) to the longitudinal direction L.

The cap 24 may include a first internal thread 40, and/or a second internal thread 44 having a larger diameter than a diameter of first internal thread 40. The first internal thread 40 may correspond to the first thread 42, and the second internal thread 44 may correspond to the second thread 46. The first internal thread 40 may be formed at a radial center of the cap 24 and/or at a position corresponding to the position of first thread 42, to match the first thread 42. The second internal thread 44 may be formed in the cap 24 to coincide with the second thread 46. In this manner, the cap 24 may be secured to the rod 30 and/or the side wall 26 by engaging the first internal thread 40 of the cap 24 to the first thread 42 of the rod 30, and/or engaging the second internal thread 44 of the cap 24 to the second thread 46 of the side wall 26. Alternatively, the cap 24 may omit the first internal thread 40 and/or the second internal thread 44 (and the rod 30 may omit the first thread 42 and/or the side wall 26 may omit the second thread 46). In such an alternative embodiment, the cap 24 may be secured to the shaver handle 2 by a snap fit onto the proximal end 26*c* of the side wall 26, or by a pressure fit into the opening 25. It is further contemplated that a combination of securement mechanisms may be utilized.

The sealing member 38 may include an elastomeric material (e.g., rubber). The sealing member 38 may be coupled to, fixed to, or otherwise formed on the interior surface 24*b* of the cap 24, so as to seal the opening 25 of the cavity 22 when the cap 24 is secured to the shaver handle 2 (e.g., by first internal thread 40 and/or second internal thread 44). For instance, the sealing member 38 may be a ring that aligns with the proximal end 26*c* of the side wall 26 such that as the cap 24 is secured to the shaver handle 2, the proximal end 26*c* engages the sealing member 38. This engagement may create a continuous seal between the proximal end 26*c* of the side wall 26 and the cap 24. The sealing member 38 may have a hole longitudinally aligned with the first internal thread 40, so that the first thread 42 of the rod 30 may pass through the hole of the sealing member 38 and engage with the first internal thread 40.

The biasing member 34 may be a spring made of any suitable material, such as plastic, rubber, metal, or a combination thereof. The biasing member 34 may have a first end 34*a* and a second end 34*b*. The biasing member 34 may have an axis between the first end 34*a* and the second end 34*b*, and the biasing member 34 may have a rest length between the first end 34*a* and the second end 34*b* on the axis. The biasing member 34 may generate a force acting along the longitudinal direction L when compressed and/or extended. The force may be constant or variable according to a displacement distance of the biasing member 34 from the rest length.

The biasing member 34 may be secured to the cap 24 at the first end 34*a* of the biasing member 34 on the interior surface 24*b* of the cap 24. The biasing member 34 may form a coil around a passage 34*c* positioned along the axis of the first internal thread 40 (and along an axis of the rod 30 when the adjustable weight assembly 20 is assembled), so that the first thread 42 of the rod 30 (and rod 30 itself) may pass through the passage 34*c* of the biasing member 34 and engage with the first internal thread 40. The second end 34*b* of the biasing member 34 (and ring 36) may contact and engage the one or more weight(s) 32 (if inserted into the cavity 22). In some embodiments, ring 36 may directly contact a weight 32 positioned closest to cap 24. However, in embodiments omitting ring 36, the second end 34*b* of biasing member 34 may directly contact a weight 32 positioned closest to cap 24. The biasing member 34 may compress and secure the one or more weight(s) 32 to the base 28 when the cap 24 is secured to the shaver handle 2. In some embodiments, the rest length of the biasing member 34 may be longer than a length of the rod 30.

While FIGS. 2 and 3 depict the biasing member 34 as a spiral spring, the spring may be any suitable spring that provides the force to secure the one or more weight(s) 32 in place when compressed. For instance, the force may be variable as the biasing member 34 is compressed to account for the increase in a number of the one or more weight(s) 32. The stiffness of the biasing member 34 may be set to overcome the force of gravity on a maximum number of weight(s) 32 accommodated by the adjustable weight assembly 20 and a predefined amount of acceleration force on the maximum number of weight(s) 32, the ring 36, and the biasing member 34. For instance, when the biasing member 34 is a spring, a spring constant k of the spring may be at least 50 N/m up to 735 N/m, and preferably between 350 N/m and 550 N/m. Further, as discussed below in another aspect of the disclosure, the biasing member 34 may be a telescoping rod that provides the force to secure the one or more weight(s) 32.

The ring 36 may be a washer made of any suitable material, such as plastic, rubber, metal, or a combination thereof. The ring 36 may be attached to the biasing member 34 at the second end of the biasing member 34. The ring 36 may have a hole at its radial center, or at another location to align with the longitudinal axis of the first internal thread 40, so that the first thread 42 of the rod 30 may pass through the hole of the ring 36 and engage with the first internal thread 40. The ring 36 may distribute the longitudinal force of the biasing member 34 to the one or more weight(s) 32 and/or to the base 28.

Figure 4:
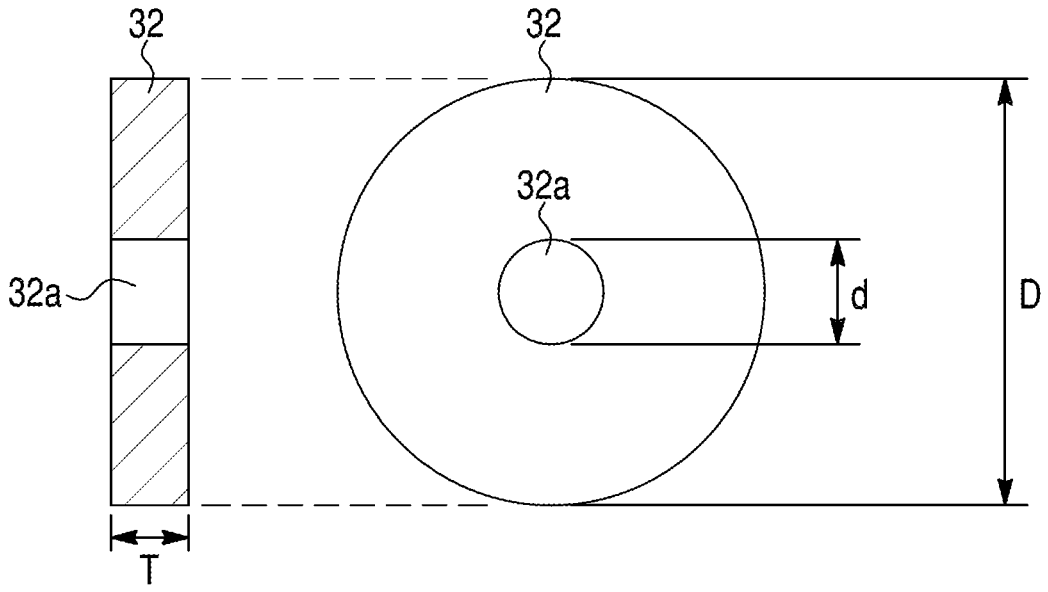
FIG. 4 depicts a weight for the exemplary shaver handle of FIGS. 2 and 3.

As shown in FIG. 4, a weight 32 for the exemplary shaver handle of FIGS. 2 and 3, may be a cylinder with an outer diameter D, a thickness T, and an inner diameter d of a hole 32*a*. However, the weight 32 may instead be a cuboid of similar dimensions (or any other suitable shape) and include a hole of similar dimensions as discussed below. The hole 32*a* may also be a cylinder, but it may be a cuboid or have another suitable shape. The weight 32 may include a metal material (e.g., steel, stainless steel), but the weight 32 may also include rubber, plastic, ceramic, etc. The one or more weight(s) 32 of a set may be uniform so as to be consistent in size dimensions, weights, and material, or the one or more weight(s) 32 of a set may vary with regards to the size dimensions, the weights, or the materials forming the respective weights. The thickness T of the weight 32 may be 2 mm to 10 mm, and preferably 4 mm to 6 mm. The outer diameter D of the weight 32 may be 80 mm to 150 mm, and preferably 95 mm to 120 mm. The inner diameter d of the hole 32*a* of the weight 32 may be 3 mm to 6 mm, and preferably 3-4 mm. The maximum number of weight(s) 32 may be 1 to 20 or more. The mass of the weight 32 may be 0.3 grams to 15 grams, and preferably 2 grams to 5 grams.

Returning to FIGS. 2 and 3, the rod 30 may be a cylinder, cuboid, or other suitable shape, that has a cross-sectional area in the longitudinal direction L that is at least circumscribed by cross-sectional areas of the hole(s) 32*a* of the one or more weight(s) 32, the passage 34*c* of the biasing member 34, and the hole of the ring 36. For instance, in the case of the hole 32*a* being a cylinder with the inner diameter d as discussed above, and the rod 30 being a cylinder with an outer diameter, the outer diameter of the rod 30 may be equal to or less than the inner diameter d of the hole 32*a*. Similarly, the outer diameter of the rod 30 may be (1) equal to or less than a diameter of the hole of the ring 36 and (2) equal to or less than a diameter of the passage 34*c* of the biasing member 34. The base 28 may extend in the direction transverse to the longitudinal direction L between the side wall 26 within the shaver handle 2 for a base length. The base length of the base 28 may be at least equal to the outer diameter D of the one or more weight(s) 32 and/or an outer diameter of the ring 36. For instance, the base length may be at least equal to or greater than the outer diameter D of a smallest weight 32 of the one or more weight(s) of a set, the outer diameter D of a largest weight of the one or more weight(s) of the set, and/or an average of the outer diameters D of the one or more weight(s) of the set.

In this way, the one or more weight(s) 32 may be positioned onto the rod 30 by inserting the rod 30 into the holes 32*a* of the one or more weight(s) 32. A first weight of the one or more weight(s) 32 that is inserted into the cavity 22 and onto the rod 30 may contact the base 28. The ring 36 may also be positioned onto the rod 30 by inserting the rod 30 into the hole of the ring 36, and the ring 36 may contact the base 28 (if no weights 32 are inserted into cavity 22) or ring 36 may contact a last weight 32 inserted into the cavity 22 onto the rod 30 (the weight 32 positioned closest to cap 24). The biasing member 34 may push the ring 36 and/or the one or more weight(s) 32 until the ring 36 and/or the one or more weight(s) 32 are secured against base 28. The biasing member 34 may be compressed to secure the one or more weight(s) 32 to the base 28, and the cap 24 may be coupled to the shaver handle 2 (e.g., by mating the first thread 42 of the rod 30 with the first internal thread 40 of the cap and/or the second thread 46 with the second internal thread 48).

A user of the adjustable weight assembly 20 may open the cap 24 (e.g., by rotating the cap 24 to disengage the first thread 42 and the first internal thread 40) and remove the cap 24 and the biasing member 34 from the shaver handle 2. Then, the user may add or remove weights 32 to/from the rod 30 in order to adjust a total weight of the adjustable weight assembly 20, according to user preference. Once the desired weight is achieved, the user may insert the biasing member 34 into cavity 22 and position the cap 24 over the opening 25. Then, the user may close the cap 24 (e.g., rotating the cap 24 to engage the first thread 42 with the first internal thread 40 and/or the second thread 46 with the second internal thread 48). The biasing member 34 may secure the weight(s) 32 inside the cavity 22 along the longitudinal direction L, while the rod 30 may secure the weight(s) 32 in a direction transverse from the longitudinal direction L. The sealing member 38 may seal the cavity 22 with the weight(s) 32 secured inside, so that water, shaving debris, and/or other contaminants may not enter the cavity 22.

In one aspect of the disclosure, the biasing member 34 may be directly attached and/or fixed to the cap 24. However, in another aspect of the disclosure, the biasing member 34 may not be directly attached and/or fixed to the cap 24, but instead may be removably attached, so that the biasing member 34 may inserted into the cavity 22 and compressed by the cap 24 when the user is closing the adjustable weight assembly 20.

In another aspect of the disclosure, one ring 36 or a pair of rings 36 may be attached to the biasing member 34 at the first end 34*a* of the biasing member 34 and/or the second end 34*b* of the biasing member 34. For instance, the biasing member 34 may have ring 36 attached to both the first end 34*a* and the second end 34*b*, so that the ring 36 on the first end 34*a* may directly contact the cap 24 and the ring 36 on the second end 34*b* may directly contact the one or more weight(s) 32. In another embodiment, the biasing member 34 may have the ring 36 attached to the first end 34*a* and no ring 36 attached to the second end 34*b*, so that the ring 36 on the first end 34*a* may directly contact the cap 24 and the second end of the biasing member 34 may directly contact the one or more weight(s) 32. In yet another embodiment, the biasing member 34 may have the ring 36 attached to the second end 34*b* and no ring 36 attached to the first end 34*a*, so that the first end 34*a* of the biasing member 34 may directly contact the cap 24 and the ring 36 on the second end 36*b* may directly contact the one or more weight(s) 32. In yet another embodiment, no ring 36 is included in the adjustable weight assembly 20, so that the first end 34*a* of the biasing member 34 may directly contact the cap 24 and the second end 34*b* of the biasing member 34 may directly contact the one or more weight(s) 32.

In another aspect of the disclosure, the second internal thread 44 and the second thread 46 may be omitted, and only the first thread 42 and the first internal thread 40 may secure the cap 24 to the shaver handle 2. Alternatively, the first thread 42 and the first internal thread 40 may be omitted, and only the second internal thread 44 and the second thread 46 may secure the cap 24 to the shaver handle 2.

Therefore, the adjustable weight assembly 20 of the present disclosure may allow a user to adjust the weight of the shaver handle to the preference of the user. Some advantages of the adjustable weight assembly 20 of the present disclosure may be: (1) personalization/customization; (2) enhanced shaving performance; and (3) a high technology feeling. The enhanced shaving performance may include better control of the shaver during shaving; ease of holding the shaver; better maneuverability of the shaver; improved shaver glide; and improved shaver balance.

Figure 5:
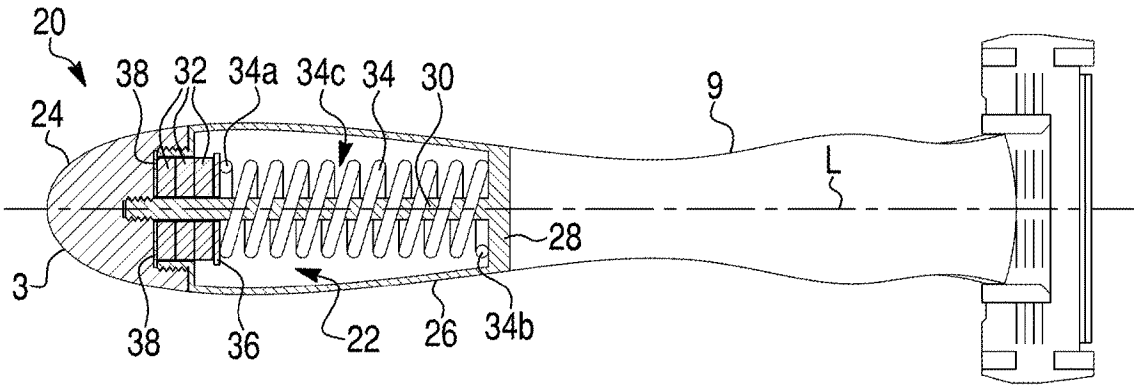
FIG. 5 is a top-down view of a shaver with an exemplary shaver handle shown in cross-section, according to a second aspect of the disclosure.
Figure 6:
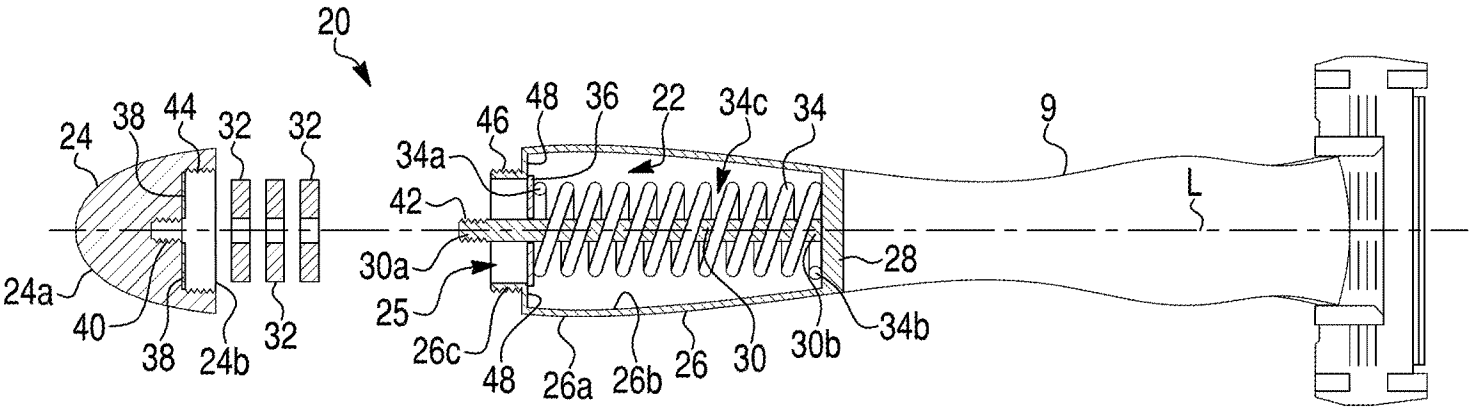
FIG. 6 is a top-down view of the shaver with the exemplary shaver handle shown in cross-section and exploded, according to the second aspect of the disclosure.

FIG. 5 is a top-down view of a shaver with an exemplary shaver handle shown in cross-section, according to a second aspect of the disclosure. FIG. 6 is a top-down view of the shaver with the exemplary shaver handle 2 shown in cross-section and exploded, according to the second aspect of the disclosure. Specifically, the shaver handle 2 may include the adjustable weight assembly 20 in accordance with the second aspect of the disclosure. As shown in FIG. 5, the top-down view of the exemplary shaver handle shown in cross-section depicts the adjustable weight assembly 20 with three weights 32, although any other suitable number may be used.

In contrast with the first aspect of the disclosure, in the second aspect of the disclosure, the biasing member 34 is coupled or fixed to the base 28, while the ring 36 is also located inside the cavity 22. Specifically, the first end 34*a* of the biasing member 34 may be coupled or fixed to the base 28 instead of the cap 24, as in the first aspect of the disclosure. The passage 34*c* of the biasing member 34 may surround the rod 30.

The adjustable weight assembly 20 of the second aspect may also include a retaining member 48, shoulder, or stop extending radially inward from the side wall 26 to retain the ring 36 within cavity 22. The retaining member 48 may be located near the proximal end 26*c* of the side wall 26. For instance, the retaining member 48 may be adjacent to the second thread 46 of the proximal end 26*c* of the side wall 26. The retaining member 48 may be a gradual narrowing of the side wall 26, a protrusion, or a step radially inward towards the longitudinal direction L. The retaining member 48 may retain the ring 36 and the biasing member 34 inside the cavity 22 when the cap 24 is removed, while still allowing the one or more weight(s) 32 through opening 25. The biasing member 34 may be compressed (as compared to the rest length of the biasing member 34) when the retaining member 48 retains the ring 36, and the biasing member 34 may be further compressed when one or more of the one or more weight(s) 32 are inserted into the cavity 22.

In the second aspect of the disclosure, a user may open and remove the cap 24. Then, the user may add or remove weight(s) 32 so as to compress or decompress the biasing member 34. Then, the user may close the cap 24. The weight(s) 32 may be secured by the biasing member 34 against the cap 24 in the longitudinal direction L and secured in the direction transverse to the longitudinal direction L by the rod 30.

Figure 7:
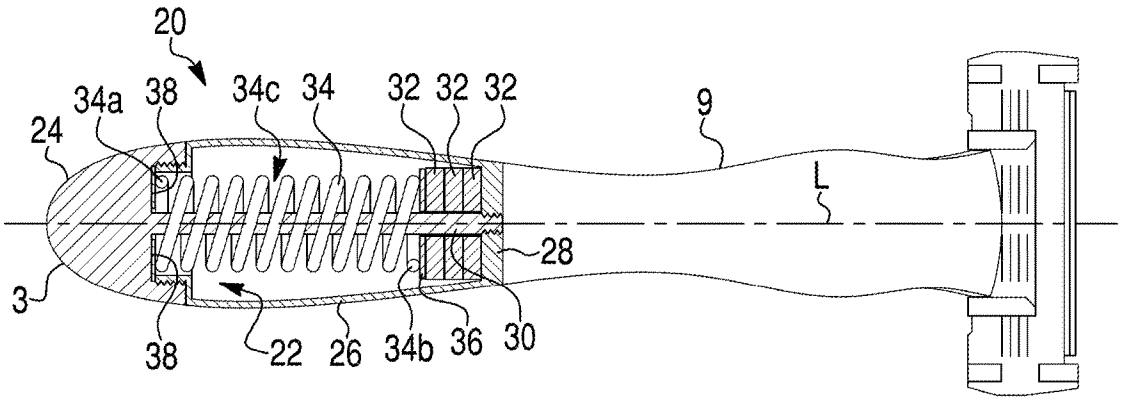
FIG. 7 is a top-down view of a shaver with an exemplary shaver handle shown in cross-section, according to a third aspect of the disclosure.
Figure 8:
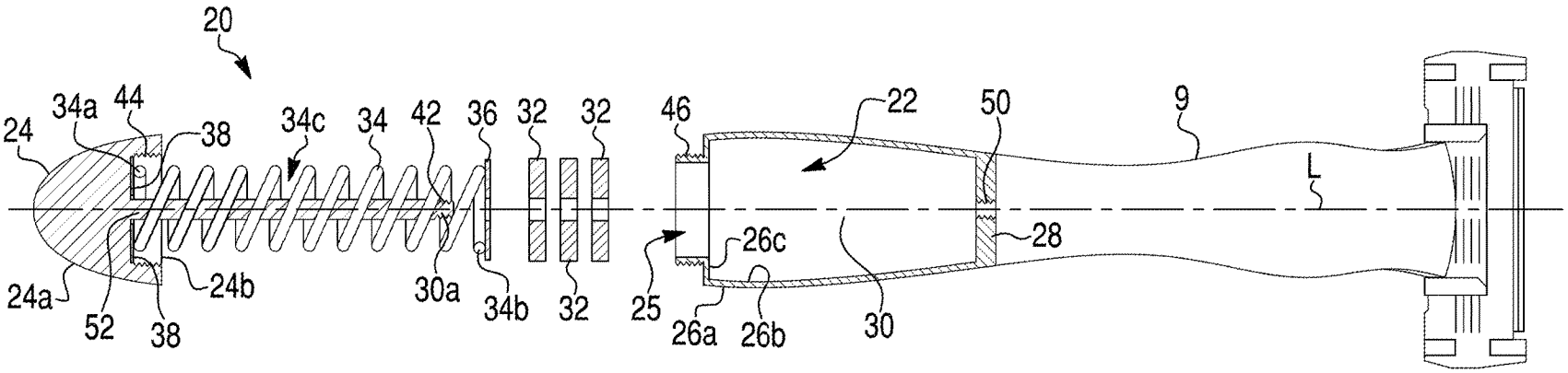
FIG. 8 is a top-down view of the shaver with the exemplary shaver handle shown in cross-section and exploded, according to the third aspect of the disclosure.

FIG. 7 is a top-down view of a shaver with an exemplary shaver handle shown in cross-section, according to a third aspect of the disclosure. FIG. 8 is a top-down view of the shaver with the exemplary shaver handle shown in cross-section and exploded, according to the third aspect of the disclosure. Specifically, the shaver handle 2 may include the adjustable weight assembly 20 in accordance with the third aspect of the disclosure. As shown in FIG. 7, the top-down view of the of the exemplary shaver handle shown in cross-section may depict the adjustable weight assembly 20 as configured with three weights 32.

In contrast with the first aspect of the disclosure, in the third aspect of the disclosure rod 30 is fixed to or otherwise coupled to the cap 24, while a third internal thread 50 may be located in the base 28. Specifically, a cap end 52 of the rod 30 may be fixed to the cap 24. The cap end 52 may be opposite the connector end 30*a* of the rod 30. The passage 34*c* of the biasing member 34 may surround the rod 30.

Therefore, in the third aspect of the disclosure, a user may open and remove the cap 24 (and remove the rod 30, the biasing member 34, and the ring 36) from the shaver handle 2. Then, the user may add or remove weight(s) 32 to/from the rod 30 to compress or decompress the biasing member 34 over the rod 30. Then, the user may insert the rod 30, biasing member 34, the ring 36, and the weight(s) 32 into the opening 25. Then, the user may close the cap 24. The weight(s) 32 may be secured by the biasing member 34 against the base 28 in the longitudinal direction L and secured in the direction transverse to the longitudinal direction L by the rod 30.

Figure 9:
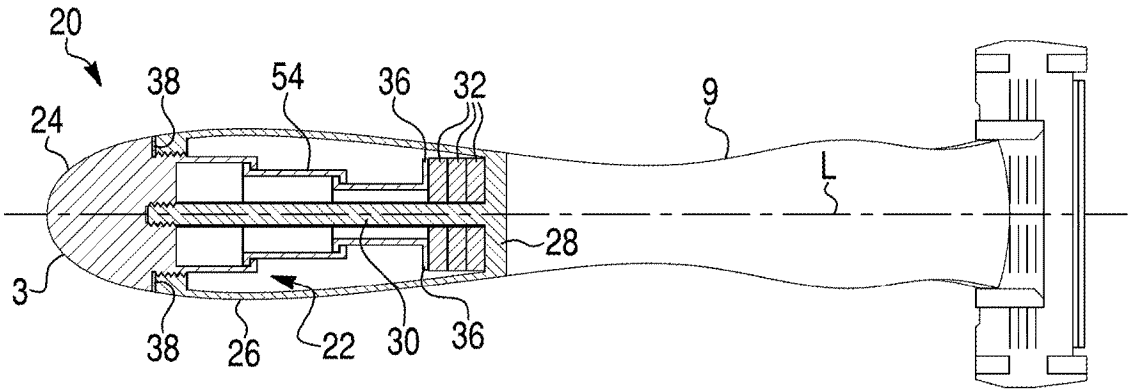
FIG. 9 is a top-down view of a shaver with an exemplary shaver handle shown in cross-section, according to a fourth aspect of the disclosure.
Figure 10:
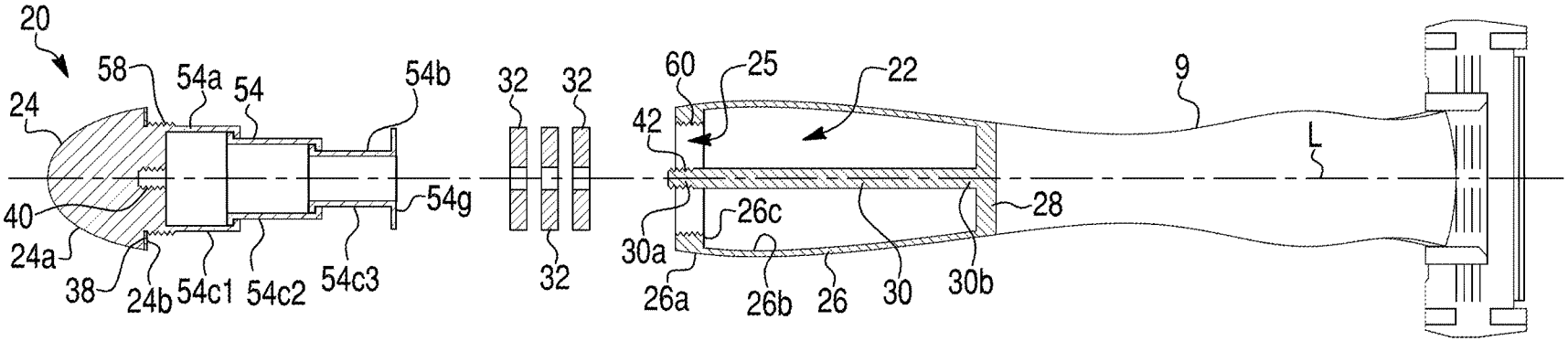
FIG. 10 is a top-down view of the shaver with the exemplary shaver handle shown in cross-section and exploded, according to the fourth aspect of the disclosure.
Figure 11:
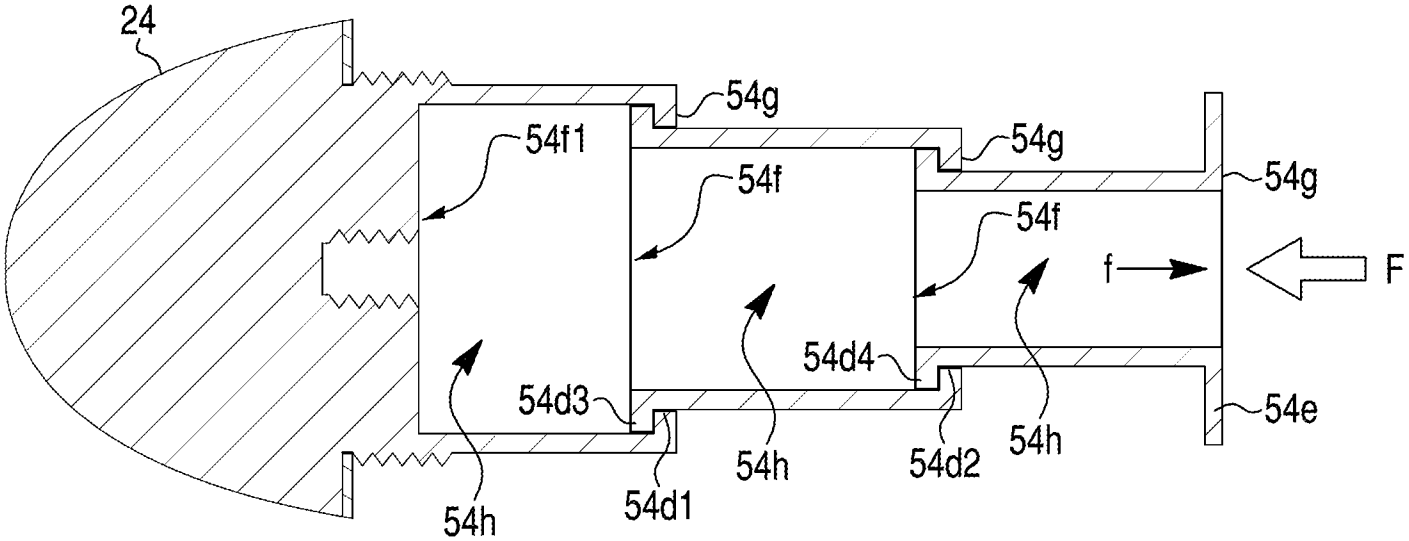
FIG. 11 is an illustrative view of a telescoping rod shown in cross-section of the exemplary shaver handle, according to the fourth aspect of the disclosure.

FIG. 9 is a top-down view of a shaver with an exemplary shaver handle shown in cross-section, according to a fourth aspect of the disclosure. FIG. 10 is a top-down view of the shaver 1 with the exemplary shaver handle 2 shown in cross-section and exploded, according to the fourth aspect of the disclosure. FIG. 11 is an illustrative view of a telescoping rod shown in cross-section of the exemplary shaver handle 2, according to the fourth aspect of the disclosure. Specifically, the shaver handle 2 may include the adjustable weight assembly 20 in accordance with the fourth aspect of the disclosure. As shown in FIG. 9, the top-down view of the exemplary shaver handle 2 shown in cross-section may depict the adjustable weight assembly 20 with three weights 32. As shown in FIG. 10, the top-down view of the exemplary shaver handle 2 shown in cross-section and exploded may depict the adjustable weight assembly 20 as broken into its constituent parts. As shown in FIG. 11, the illustrative view of the telescoping rod 54 shown in cross-section of the exemplary shaver handle 2 illustrates a force F from weights 32 acts on the telescoping rod 54.

In contrast with the first aspect of the disclosure, the fourth aspect of the disclosure may have a telescoping rod 54 instead of a spring or other biasing member. Specifically, telescoping rod 54 may include a first end 54*a* and a second end 54*b* opposite the first end 54*a*. The telescoping rod 54 may be attached to the cap 24 at the first end 54*a*.

The telescoping rod 54 may include two or more telescoping sections (such as, e.g., 54*c*1, 54*c*2, and 54*c*3 depicted in FIG. 10) that may slide relative to each other as the telescoping rod 54 is compressed or extended. The two or more telescoping sections 54*c* may be generally cylindrical and each may have an open distal end 54*g*, and an open interior 54*h*. The proximal end of the first telescoping section 54*c*1 may be defined by a distally facing surface 54*f*1 of cap 24. The telescoping sections distal to 54*c*1 (e.g., the second telescoping section 54*c*2 and the third telescoping section 54*c*3) may have an open proximal end 54*f*. The two or more telescoping sections 54*c*1, 54*c*2, and 54*c*3 may be hollow concentric cylinders that slide relative to an adjacent telescoping section 54*c*1, 54*c*2, and 54*c*3. For example, an inner diameter of the first telescoping section cylinder 54*c*1 may be larger than an outer diameter of the second telescoping section cylinder 54*c*2. The second telescoping section cylinder 54*c*2 is configured to extend distally of the first telescoping section cylinder 54*c*1. Moreover, the telescoping sections 54*c*1, 54*c*2, and 54*c*3 may include one or more features, such as, e.g., flanges, protrusions, and/or grooves, to secure to one another in the extended configuration that prevents the telescoping sections 54*c*1, 54*c*2, and 54*c*3 from being separated when the user fully extends the telescoping rod 54. For instance, the two or more telescoping sections 54*c*1, 54*c*2, and 54*c*3 may have radially inward extending flanges 54*d*1 and 54*d*2 and radially outward extending flanges 54*d*3 and 54*d*4 that engage each other, respectfully, when adjacent telescoping sections of telescoping rod 54 are fully extended relative to each other. Specifically, the first telescoping section 54*c*1 may have a flange 54*d*1 at the open distal end 54*g* that extends radially inward from the body of the first telescoping section 54*c*1. The second telescoping section 54*c*2 may have a flange 54*d*2 at the open distal end 54*g* that extends radially inward from the body of the second telescoping section 54*c*2, and a flange 54*d*3 at the open proximal end 54*f* that extends radially outward from the body of the second telescoping section 54*c*2. The third telescoping section 54*c*3 may have a flange 54*d*4 at the open proximal end 54*f* that extends radially outward from the body of the second telescoping section 54*c*2. The flange 54*d*1 may engage the flange 54*d*3, and the flange 54*d*2 may engage the flange 54*d*4. The radially inward extending flanges 54*d*1 and 54*d*2 and the radially outward extending flanges 54*d*3 and 54*d*4 may protrude continuously along a circumference of the two or more telescoping sections 54*c*1, 54*c*2, and 54*c*3. Alternatively, one of the flanges 54*d*1, 54*d*2, 54*d*3, or 54*d*4 may protrude continuously along the circumference of a respective telescoping section 54*c*1, 54*c*2, and 54*c*3, while a corresponding flange 54*d*1, 54*d*2, 54*d*3, or 54*d*4 may protrude in one or more arc lengths along less than an entirety of the circumference of a respective telescoping section 54*c*1, 54*c*2, and 54*c*3, so as to engage the continuously extending one of the flanges 54*d*1, 54*d*2, 54*d*3, or 54*d*4.

The telescoping rod 54 may also include a flange 54*e* (instead of the ring 36) at the second end 54*b* of the telescoping rod 54 to contact one or more weights 32, and push the weights 32 along the longitudinal direction L of the rod 30 until the weights 32 are secured against the base 28. The flange 54*e* may extend radially outward from an end of the distalmost telescoping section (such as 54*c*3 of FIG. 10).

Further, the fourth aspect of the disclosure may also differ from the first aspect of the disclosure, by having a third thread 58 on the cap 24, while a fourth internal thread 60 is on the proximal end 26*c* of the side wall 26.

Therefore, in the fourth aspect of the disclosure, a user may open and remove the cap 24 (and remove the telescoping rod 54) from shaver handle 2. Then, the user may add or remove weight(s) 32 to/from the rod 30. Then, the user may insert the telescoping rod 54 into the opening 25 to secure the weights 32 against the base 28. Then, the user may close the cap 24. The weight(s) 32 may be secured by the telescoping rod 54 against the base 28 in the longitudinal direction L and secured in the direction transverse to the longitudinal direction L by the rod 30.

Adjacent telescoping sections 54*c*1, 54*c*2, and 54*c*3 of telescoping rod 54 may be secured to one another in the extended configuration by a friction fit and by the abutment of various flanges of adjacent telescoping sections 54*c*1, 54*c*2, and 54*c*3. The force needed to overcome the friction fit, snap fit, or similar connection, of adjacent telescoping sections 54*c*1, 54*c*2, and 54*c*3 may be greater than a force F of the weights 32 acting against telescoping rod 54 (see FIG. 11). In one aspect of the disclosure, the telescoping rod 54, due to the friction between the telescoping sections 54*c*1, 54*c*2, and 54*c*3, secures the one or more weights 32 in the fully extended configuration, in the fully collapsed configuration, and/or in every position between the fully extended configuration and the fully collapsed configuration. For instance, the telescoping section 54*c*1, 54*c*2, and 54*c*3 may secure a first number of weights 32 (e.g., one, two, or three) in the fully extended configuration; secure the first number of weights 32 plus one or more additional weights 32 in positions between the fully extended configuration and the fully collapsed configuration; and secure the maximum number of weights 32 in the fully collapsed configuration.

In another aspect of the disclosure, it is contemplated that, in use, a given telescoping section 54*c*1, 54*c*2, and 54*c*3 is either fully extended, or is collapsed, and the number of weights 32 added to the shaver handle 2 is consistent with such an arrangement. For example, a fully extended telescoping rod 54 may be configured to secure one or more weights 32 within the shaver handle 2. However, in some embodiments, telescoping rod 54 may be unable to secure only one or two weights 32 within the shaver handle 2, without allowing those weights 32 to be loose within the shaver handle 2. Furthermore, if a user would like to add additional weights 32 beyond the three weights 32 shown in FIG. 9, in order to ensure that weights 32 are fully secure (not loose), a user may be required to add enough weights 32 (or other filler material) so that the distalmost telescoping section 54*c*3 is fully collapsed within adjacent telescoping section 54*c*2.

As is evident from the figures and text presented above, as well as the examples below, a variety of embodiments are contemplated:

Embodiment 1. A shaver handle assembly, comprising: a body defining a cavity; one or more weights insertable into the cavity; a cap removably coupled to the body to enable access to the cavity when the cap is removed from the body; and a biasing member configured to abut at least one of the one or more weights, to secure the one or more weights within the cavity.

Embodiment 2. The shaver handle assembly of Embodiment 1, further including a rod extending through the cavity, wherein each of the one or more weights is configured to slide onto the rod.

Embodiment 3. The shaver handle assembly of Embodiment 2, wherein the rod is coupled to the cap or to the body.

Embodiment 4. The shaver handle assembly of any one of Embodiment 2 or Embodiment 3, wherein the rod includes a first thread at a first end of the rod opposite a second end of the rod coupled to the body; and the cap includes a first internal thread configured to engage with the first thread.

Embodiment 5. The shaver handle assembly of Embodiment 4, wherein the body includes a second thread; and the cap further includes a second internal thread configured to engage with the second thread.

Embodiment 6. The shaver handle assembly of Embodiment 5, wherein the second internal thread has a larger diameter than the first internal thread, and the second thread has a larger diameter than the first thread.

Embodiment 7. The shaver handle assembly of any of the preceding Embodiments, wherein the biasing member is a spring.

Embodiment 8. The shaver handle assembly of any of the preceding Embodiments, further comprising a sealing member configured to seal the cavity when the cap is attached to the body.

Embodiment 9. The shaver handle assembly of any of the preceding Embodiments, wherein an interior of the body does not include any liquid or damping fluid.

Embodiment 10. The shaver handle assembly of any of the preceding Embodiments, wherein the one or more weights includes a plurality of weights, and at least one of the weights has a first mass, and at one of the weights has a second mass that is different than the first mass.

Embodiment 11. The shaver handle assembly of any of the preceding Embodiments, further including a ring coupled to an end of the biasing member, wherein the ring is configured to directly contact at least one of the one or more weights.

Embodiment 12. The shaver handle assembly of any of the preceding Embodiments, wherein the biasing member is coupled to the body and disposed within the cavity, when the cap is removed from the body; and the body includes a stop configured to limit expansion of the biasing member.

Embodiment 13. A shaver handle assembly, comprising: a body defining a cavity; one or more weights insertable into the cavity; a cap removably coupled to the body to enable access to the cavity when the cap is removed from the body; and a telescoping rod configured to secure the one or more weights within the cavity, wherein the telescoping rod includes two or more sections configured to slide relative to one another as the telescoping rod is compressed or extended.

Embodiment 14. The shaver handle assembly of Embodiment 13, wherein adjacent sections of the telescoping rod are held in an extended configuration by a friction force, wherein the friction force is greater than a force of the one or more weights configured to act on the telescoping rod.

Embodiment 15. The shaver handle assembly of any one of Embodiment 13 or Embodiment 14, wherein the telescoping rod is coupled to the cap.

Embodiment 16. The shaver handle assembly of any one of Embodiment 13 through Embodiment 15, wherein a distalmost section of the telescoping rod includes a flange configured to abut at least one of the one or more weights.

Embodiment 17. The shaver handle assembly of any one of Embodiment 13 through Embodiment 16, wherein each of the sections of the telescoping rod is hollow.

Embodiment 18. The shaver handle assembly of any one of Embodiment 13 through Embodiment 17, further including a rod extending through the cavity, and extending through the telescoping assembly, when the cap is coupled to the body, wherein each of the one or more weights is configured to slide onto the rod.

Embodiment 19. A shaver, comprising: a shaver head; and a handle coupled to the shaver head, the handle including: a body defining a cavity; one or more weights insertable into the cavity; a cap removably coupled to the body to enable access to the cavity when the cap is removed from the body; and a biasing member configured to abut at least one of the one or more weights, to secure the one or more weights within the cavity.

Embodiment 20. The shaver of Embodiment 19, wherein an interior of the body does not include any liquid or damping fluid.

All technical and scientific terms used herein have the same meaning as commonly understood to one of ordinary skill in the art to which this disclosure belongs unless clearly indicated otherwise. As used herein, the singular forms "a", "an", and "the" include plural references unless the context clearly dictates otherwise. Thus, for example, reference to "a blade" may include a plurality of such blades and reference to "the blade" may include reference to one or more blades and equivalents thereof known to those skilled in the art, and so forth.

The above description is illustrative and is not intended to be restrictive. One of ordinary skill in the art may make numerous modifications and/or changes without departing from the general scope of the disclosure. For example, and as has been described, the above-described embodiments (and/or aspects thereof) may be used in combination with each other. Additionally, portions of the above-described embodiments may be removed without departing from the scope of the disclosure. In addition, modifications may be made to adapt a particular situation or material to the teachings of the various embodiments without departing from their scope. Many other embodiments will also be apparent to those of skill in the art upon reviewing the above description.

What is claimed is:

1. A shaver handle assembly, comprising:

a body defining a cavity;

one or more weights insertable into the cavity;

a cap removably coupled to the body to enable access to the cavity when the cap is removed from the body;

a biasing member configured to abut at least one of the one or more weights, to secure the one or more weights within the cavity; and a sealing member configured to seal the cavity from liquid or damping fluid by abutting against at least one of the one or more weights when the cap is attached to the body, wherein the sealing member is provided on an interior surface of the cap.

2. The shaver handle assembly of claim 1, further including a rod extending through the cavity, wherein each of the one or more weights is configured to slide onto the rod.

3. The shaver handle assembly of claim 2, wherein the rod is integrally formed with the cap or the body.

4. The shaver handle assembly of claim 2, wherein:

the rod includes a first thread at a first end of the rod opposite a second end of the rod, wherein the second end of the rod is joined to the body, a remaining portion of the rod is smooth to facilitate a sliding motion of the weights along the rod; and the cap includes an exterior surface, an interior surface configured to face the cavity, and a first internal thread formed in the interior surface and configured to engage with the first thread.

5. The shaver handle assembly of claim 4, wherein:

the body includes a second thread; and the cap further includes a second internal thread formed in the interior surface and configured to engage with the second thread.

6. The shaver handle assembly of claim 5, wherein:

the second internal thread has a larger diameter than the first internal thread, the second thread has a larger diameter than the first thread, and a diameter of a passage inside the biasing member is larger than the diameter of the first internal thread, and the rod passes through the passage of the biasing member.

7. The shaver handle assembly of claim 6, wherein:

each weight of the one or more weights includes a hole extending through its center;

the rod extends through the cavity and the one or more holes of the one or more weights;

the second thread is formed on an outer circumferential surface of the body;

the first internal thread of the cap is configured to engage with the first thread of the rod to enable access to the cavity when the first internal thread of the cap disengages from the first thread of the rod; and the internal surface of the cap includes:

a first inner circumferential surface formed with the first internal thread configured to engage with the first thread of the rod;

a second inner circumferential surface formed with the second internal thread configured to engage with the second thread of the body, a diameter of the second inner circumferential surface being larger than a diameter of the first inner circumferential surface; and a stepped surface provided between the first inner circumferential surface and the second inner circumferential surface with respect to an axial direction of the rod, wherein a sealing member is provided on the stepped surface and configured such that, when the cap is engaged with the body and the rod, the sealing member abuts against the one or more weights to seal the cavity from liquid, and wherein the sealing member includes an opening through which the rod passes; and the body includes a base configured to face the stepped surface of the cap when the cap is engaged with the body and the rod;

the second end of the rod is fixed to the base;

the first and second interior surfaces of the cap are configured to face the base when the cap is coupled to the body;

biasing member includes a first end and a second end opposite the first end;

the first end of the biasing member is configured to abut against the base;

the second end of the biasing member is configured to abut against the one or more weights;

the biasing member has a resting length configured such that, when the cap is coupled to the body, the biasing member abuts the base and the one or more weights to exert an elastic restoring force on at least one of the one or more weights against the sealing member and the stepped surface of the cap to secure the one or more weights within the cavity and to seal the cavity from liquid;

the biasing member is a spring having a spring constant within a range of 50 N/m to 735 N/m, the one or more weights each has a mass from 0.3 g to 15 g;

the one or more weights each has a thickness from 2 millimeters (mm) to 10 mm; and the one or more weights each has an outer diameter from 80 mm to 150 mm.

8. The shaver handle assembly of claim 1, wherein:

the one or more weights includes a plurality of weights;

at least one of the weights has a first mass;

another of the weights has a second mass that is different than the first mass; and the first mass and the second mass each is from 2 to 5 grams (g).

9. The shaver handle assembly of claim 1, further including a ring coupled to an end of the biasing member and a rod passing through the ring, the biasing member, and the one or more weights, the one or more weights being formed with holes through which the rod extends, wherein the ring is configured to directly contact at least one of the one or more weights.

10. The shaver handle assembly of claim 1, further comprising a rod extending through the cavity and inserted through the biasing member and the one or more weights, wherein:

the biasing member is fixed to the body and disposed within the cavity, wherein the biasing member has a resting length which is longer than the rod; and the body includes a stop configured to limit expansion of the biasing member.

11. A shaver, comprising:

a shaver head; and a handle coupled to the shaver head, the handle including:

a body defining a cavity;

one or more weights insertable into the cavity, each weight of the one or more weights including a hole extending through its center;

a rod having a first end fixed to the body and a second end opposite the first end, the rod extending through the cavity and the holes of the one or more weights;

a cap configured to threadingly engage with the second end of the rod to enable access to the cavity when the cap is disengaged from the rod; and a biasing member configured to abut at least one of the one or more weights to secure the one or more weights within the cavity, wherein the rod extends through the biasing member, and the weights are configured to slide off the rod for removal, wherein:

the second end of the rod includes a first thread;

an outer circumferential surface of the body includes a second thread;

the cap includes an interior surface and an exterior surface; and the interior surface includes:

a first inner circumferential surface formed with a first internal thread configured to engage with the first thread;

a second inner circumferential surface formed with a second internal thread configured to engage with the second thread, a diameter of the second inner circumferential surface being greater than a diameter of the first inner circumferential surface; and a stepped surface provided between the first inner circumferential surface and the second inner circumferential surface with respect to an axial direction of the rod, wherein a sealing member is provided on the stepped surface and configured such that, when the cap is engaged with the body and the rod, the sealing member abuts against the one or more weights to seal the cavity from liquid, and wherein the sealing member includes an opening through which the rod passes.

12. The shaver of claim 11, wherein:

the body includes a base configured to face the stepped surface of the cap when the cap is engaged with the body and the rod;

the first end of the rod is fixed to the base; and the biasing member includes a first end and a second end opposite the first end, wherein the first end of the biasing member is configured to abut against the base, and the second end of the biasing member is configured to abut against the one or more weights.

13. A shaver handle assembly, comprising:

a body defining a cavity;

one or more weights insertable into the cavity;

a cap removably coupled to the body to enable access to the cavity when the cap is removed from the body;

a biasing member configured to abut at least one of the one or more weights, to secure the one or more weights within the cavity; and a rod extending through the cavity and inserted through the biasing member and the one or more weights, wherein:

the biasing member is fixed to the body and disposed within the cavity, wherein the biasing member has a resting length which is longer than the rod; and the body includes a stop configured to limit expansion of the biasing member.

* * * * *